US007310841B2

(12) United States Patent
Chen

(10) Patent No.: US 7,310,841 B2
(45) Date of Patent: Dec. 25, 2007

(54) STATIONERY ASSEMBLY

(75) Inventor: Elephant Chen, Taichung Hsien (TW)

(73) Assignee: Big Elephant Mold, Industry Co, Ltd., Taichung Hsien (TW)

( * ) Notice: Subject to any disclaimer, the term of this patent is extended or adjusted under 35 U.S.C. 154(b) by 30 days.

(21) Appl. No.: 11/382,146

(22) Filed: May 8, 2006

(65) Prior Publication Data

US 2007/0259566 A1 Nov. 8, 2007

(51) Int. Cl.
*B26B 11/00* (2006.01)

(52) U.S. Cl. ..... 7/160; 206/214; 206/229; 206/230; 446/73; 446/76; 446/475

(58) Field of Classification Search ..... 7/160; 206/214, 229, 230; 446/73, 76, 475
See application file for complete search history.

(56) References Cited

U.S. PATENT DOCUMENTS 5,850,940 A * 12/1998 Sloan et al. ..... 222/78
6,695,667 B1 * 2/2004 Kee ..... 446/73
6,712,211 B1 * 3/2004 Chan ..... 206/457

* cited by examiner

*Primary Examiner*—Joseph J. Hail, III
*Assistant Examiner*—Shantese McDonald

(57) ABSTRACT

A stationery assembly includes a body and a partition formed on a bottom of the body for closing the body. A sound device is received in the chamber. A stapler is upwardly secured on a bottom of the body. A lighting device is mounted in a front end of the body. A first trough is defined in a top of the body. A second trough and a third trough are respectively defined in two opposite sides of the body. A first insertion, a second insertion and a third insertion are respectively and partially inserted into the first trough, the second trough and the third trough. A fourth trough is defined in a rear end of the body and a fourth insertion is partially inserted into the fourth trough. The body, the first insertion, the second insertion, the third insertion and the fourth insertion are assembled to form a dolphin model.

5 Claims, 4 Drawing Sheets

STATIONERY ASSEMBLY

BACKGROUND OF THE INVENTION

1. Field of the Invention

The present invention relates to a stationery assembly, and more particularly to a stationery assembly resembles a dolphin and provides multi-function.

2. Description of Related Art

A conventional stationery holder in accordance with the prior is usually designed as a cylinder having a chamber defined therein for arbitrarily containing stationeries. Consequently, the user needs to spend time for looking for the purposed stationery in the conventional stationery holder and the cylindrical style looks mechanical. The next user's fingers may be hurt when a sharpened end of scissors or a knife extends out of the stationery holder. Furthermore, the conventional stationery has an open end such that the conventional stationery is inconvenient for taking along.

The present invention has arisen to mitigate and/or obviate the disadvantages of the conventional stationery holder.

SUMMARY OF THE INVENTION

The main objective of the present invention is to provide an improved stationery assembly that has two functions of containing stationery and decoration.

To achieve the objective, the stationery assembly in accordance with the present invention resembles a dolphin and comprises a body having a chamber defined in the body. A partition is formed on a bottom of the body for closing the chamber. A sound device is received in the chamber and secured on the partition. A stapler is upwardly secured against the partition. A lighting device is mounted in a front end of the body. A first trough is defined in a top of the body. A second trough and a third trough are respectively defined in two opposite sides of the body. A first insertion, a second insertion and a third insertion are respectively and partially inserted into the first trough, the second trough and the third trough. A fourth trough is defined in a rear end of the body and a fourth insertion is partially inserted into the fourth trough.

Further benefits and advantages of the present invention will become apparent after a careful reading of the detailed description with appropriate reference to the accompanying drawings.

DETAILED DESCRIPTION OF THE INVENTION

Figure 1:
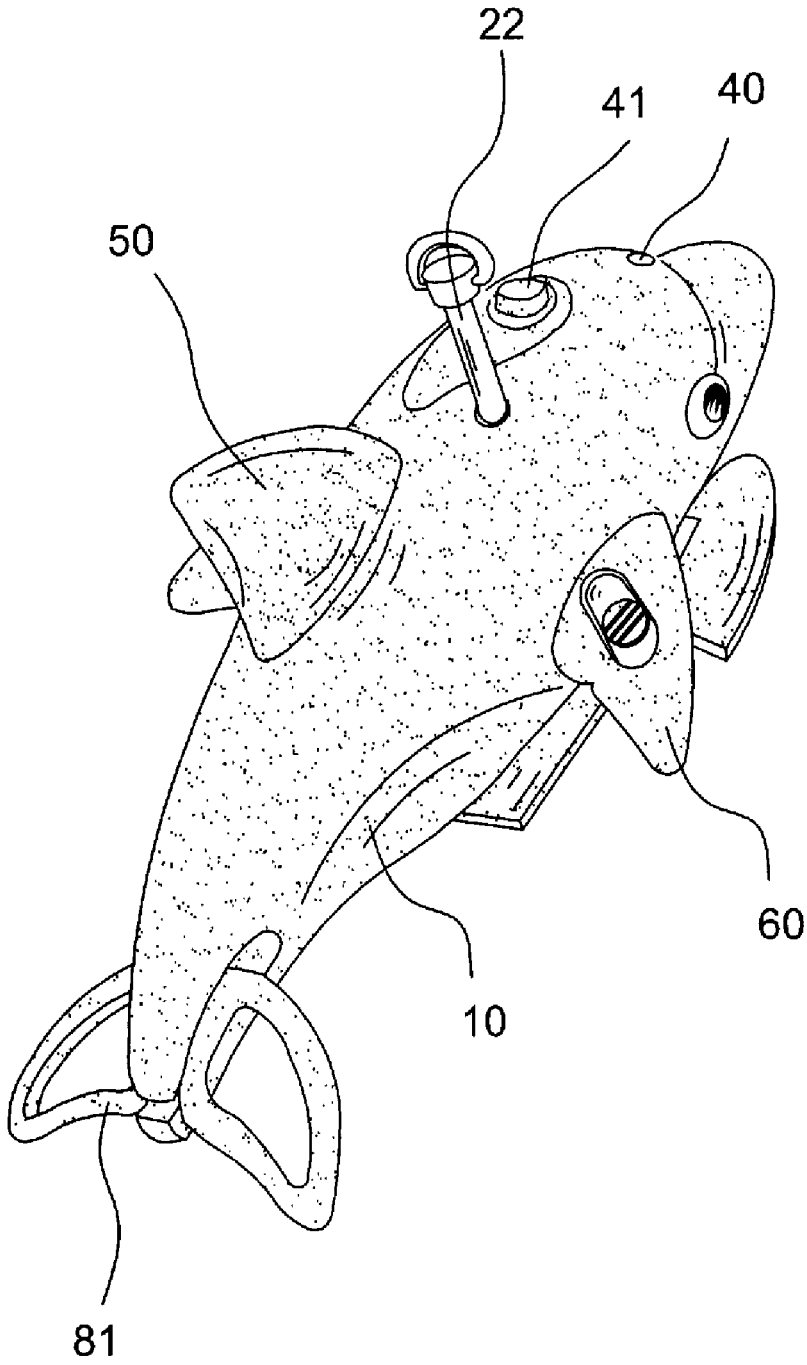
FIG. 1 is a perspective view of a stationery assembly in accordance with the present invention.
Figure 2:
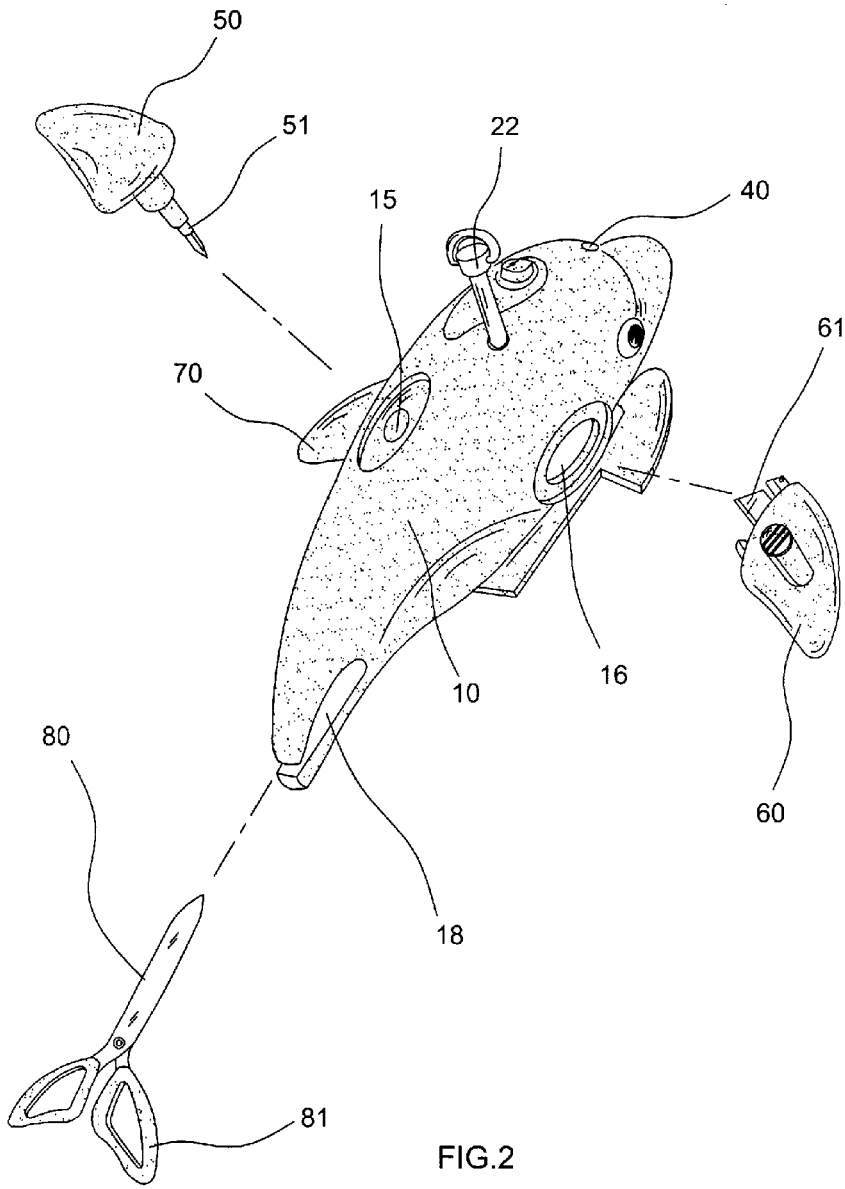
FIG. 2 is an exploded perspective view of the stationery assembly in FIG. 1.
Figure 3:
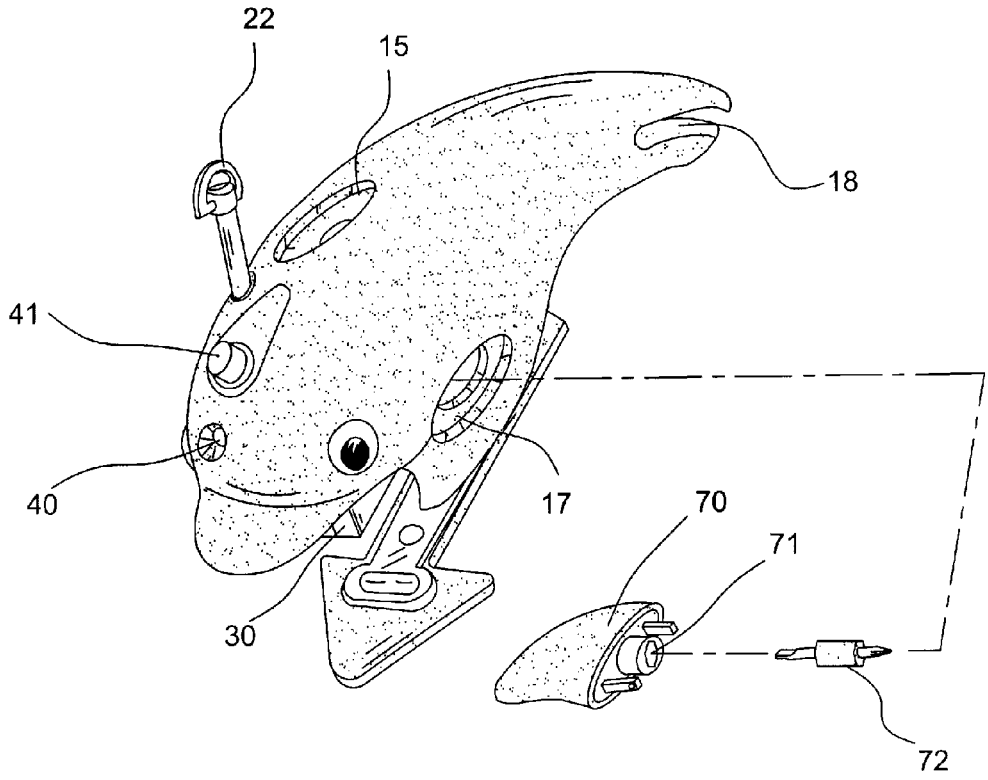
FIG. 3 is another exploded perspective view of the stationery assembly in FIG. 1.
Figure 4:
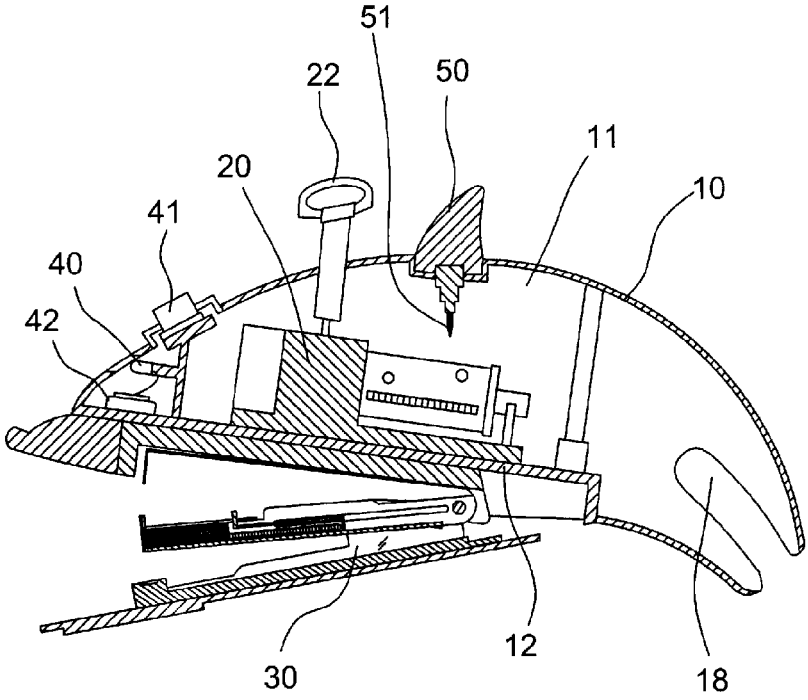
FIG. 4 is a cross-sectional view of the stationery assembly of the present invention.

Referring to the drawings and initially to FIGS. 1-4, a stationery assembly in accordance with the present invention resembles a dolphin and comprises a body (10) having a chamber (11) defined in the body (10). A partition (12) is formed on a bottom of the body (10) for closing the chamber (11). A sound device (20) is received in the chamber (11) and secured on the partition (12). A stapler (30) is upwardly secured against the partition (12). A lighting device (40) is mounted in a front end of the body (10). A first trough (15) is defined in a top of the body (10). A second trough (16) and a third trough (17) are respectively defined in two opposite sides of the body (10). A first insertion (50), a second insertion (60) and a third insertion (70) are respectively and partially inserted into the first trough (15), the second trough (16) and the third trough (17). A fourth trough (18) is defined in a rear end of the body (10) and a fourth insertion (80) is partially inserted into the fourth trough (18). The body (10), the first insertion (50), the second insertion (60), the third insertion (70) and the fourth insertion (80) are assembled to form a dolphin model.

The sound device (20) is a mechanically poke-reed sound apparatus. The user can tighten a spring (not shown) in the sound device (20) by rotating a shaft (22) that is connected to the sound device (20) and extends through the body (10). The tightened spring drives the sound device (20) for providing music and amusement effect. The lighting device (40) includes a battery (42) secured on the partition (12) for providing power to the lighting device (40) and a switch (41) mounted on a periphery of the body (10) for controlling the lighting device (40). The lighting device (40) shows the position of the stationery assembly when lighting.

The first insertion (50), the second insertion (60) and the third insertion (70) are sequentially designed as a dorsal fin, two pectoral fins. The first insertion (50) has a writing element (51) secured thereon such that the first insertion (50) provides writing function when being detaching from the body (10). The second insertion (60) has a telescopic knife (61) mounted thereon such that the second insertion (60) provides cutting function when being detaching from the body (10). The third insertion (70) has a hole (71) defined therein and a screwdriver (72) is partially received in the hole (71) for user to drive a screw. The fourth insertion (80) is designed as a scissors and the hand-held portion (81) has a tail fin style. The complete style of the stationery assembly in accordance with the present invention has two functions of containing stationery and decoration.

As described above, all the elements of the present invention are assembled to be a stationery assembly with a dolphin model for containing stationery and decoration. Various stationeries are received in the body (10) such that the stationeries are orderly collected and easily to be carried. Furthermore, the sharpened ends of the stationeries are received in the body (10) such that the user's fingers should not be hurt when taking the stationeries.

Although the invention has been explained in relation to its preferred embodiment, it is to be understood that many other possible modifications and variations can be made without departing from the spirit and scope of the invention as hereinafter claimed.

What is claimed is:

1. A stationery assembly comprising a body having a chamber defined in the body, a partition formed on a bottom of the body for closing the chamber, a sound device received in the chamber and secured on the partition, a stapler upwardly secured against the partition, a lighting device mounted in a front end of the body, a first trough defined in a top of the body, a second trough and a third trough respectively defined in two opposite sides of the body, a first insertion, a second insertion and a third insertion respectively and partially inserted into the first trough, the second trough and the third trough, a fourth trough defined in a rear end of the body and a fourth insertion partially inserted into the fourth trough, the body, the first insertion, the second insertion, the third insertion and the fourth insertion being assembled to form a dolphin model.

2. The stationery as claimed in claim 1, wherein the sound device is a mechanically poke-reed sound apparatus and has a shaft connected thereto for tightening a spring in the sound device.

3. The stationery assembly as claimed in claim 1, wherein the lighting device shows the position of the stationery assembly when lighting, the lighting device including a battery secured on the partition for providing power to the lighting device and a switch mounted on a periphery of the body for controlling the lighting device.

4. The stationery assembly as claimed in claim 1, wherein the first insertion, the second insertion and the third insertion are sequentially designed as a dorsal fin, two pectoral fins, the first insertion having a writing element secured thereon, the second insertion having a telescopic knife mounted thereon, and the third insertion having a hole defined therein and a screwdriver partially received in the hole.

5. The stationery assembly as claimed in claim 1, wherein the fourth insertion is designed as a scissors and having a hand-held portion with a tail fin style.

* * * * *